US006932007B1

(12) United States Patent
Beauchamp

(10) Patent No.: US 6,932,007 B1
(45) Date of Patent: Aug. 23, 2005

(54) VARIABLE PATTERN MAKING JIG FOR A QUILTING MACHINE

(76) Inventor: Kevin Beauchamp, 7019 County Rd. 1320, West Plains, MO (US) 65775

( * ) Notice: Subject to any disclaimer, the term of this patent is extended or adjusted under 35 U.S.C. 154(b) by 126 days.

(21) Appl. No.: 10/652,891

(22) Filed: Aug. 30, 2003

(51) Int. Cl.[7] ..... D05B 11/00
(52) U.S. Cl. ..... 112/117; 112/470.13; 33/27.01
(58) Field of Search ..... 112/117, 118, 119, 112/470.13, 470.12, 470.17, 470.18; 33/27.01

(56) References Cited

U.S. PATENT DOCUMENTS

| | | | | |
|---|---|---|---|---|
| 334,275 | A | 1/1886 | Palmer | |
| 437,439 | A | 9/1890 | Lefeber | |
| 2,236,421 | A | 3/1941 | Boettcher | |
| 2,597,686 | A | 5/1952 | Turner et al. | |
| 3,434,370 | A | 3/1969 | Scholl et al. | |
| 3,956,828 | A | 5/1976 | Kloweit | |
| 4,273,059 | A * | 6/1981 | Kamal | 112/470.13 |
| 4,669,405 | A | 6/1987 | Resta et al. | |
| 4,860,675 | A | 8/1989 | Brower et al. | |
| 4,876,976 | A | 10/1989 | Brower et al. | |
| 5,027,726 | A | 7/1991 | Brower et al. | |
| 5,040,473 | A | 8/1991 | Zesch et al. | |
| 5,711,236 | A | 1/1998 | Badger | |
| 6,860,211 | B2 * | 3/2005 | Valeriote et al. | 112/117 |

OTHER PUBLICATIONS

Printout from website www.samstoybox.com showing Kenner Spirograph toys on sale at least one year prior to the filing date of the present application.

* cited by examiner

*Primary Examiner*—Peter Nerbun
(74) *Attorney, Agent, or Firm*—Erickson & Kleypas, LLC

(57) ABSTRACT

A pattern making jig for a quilting machine of the type having a sewing machine moveably mounted on a table includes a pair of jig rails securable to the table and a jig body selectively moveable along the jig rails. A stationary gear is fixedly connected to the jig body. A pinion gear carrier rotatably connected to the jig body carries a pinion gear which is engageable with the stationary gear for orbital movement thereabout. The pinion gear carrier is adjustable to accommodate pinion gears of various sizes. A stylus wheel operably connected to the pinion gear has a plurality of stylus receivers formed therein. A stylus secured to the sewing machine is receivable in any one of the stylus receivers in the stylus wheel.

20 Claims, 5 Drawing Sheets

VARIABLE PATTERN MAKING JIG FOR A QUILTING MACHINE

BACKGROUND OF THE INVENTION

1. Field of the Invention

This invention relates to the field of quilting, and in particular to a jig for use with a quilting machine which is capable of guiding the quilting machine to stitch any of a variety of preselected patterns.

2. Description of the Related Art

For centuries, quilts have been a common item of bedding and folk art. A quilt generally has a top made of small scraps of material sewn together in a decorative pattern, a plain backing and a filler of cotton or polyester fiber batting. The layers of the quilt are sewn together in intricately stitched patterns. The process of stitching the layers together is referred to as quilting.

Traditionally, quilting is done by hand, either by an individual seamstress or by a group of seamstresses at a "quilting bee." With the industrial revolution came machine quilting, which is the use of a sewing machine for quilting. Over the years, specialized quilting machines have been developed. In general, these quilting machines fall into two groups, those where the sewing machine is held stationary and the material to be quilted is moved and those where the material is held stationary and the sewing machine is moved.

In the latter type machine, the machine is moveably mounted on a table, and the material to be quilted is supported above the table such that a portion of the material extends through the throat of the sewing machine. The stitched patterns are normally transferred to the quilt from a paper pattern or template by placing the template on the table and manually tracing it with a stylus attached to the sewing machine.

Most previous jigs for use with quilting machines and other similar devices have generally comprised guides or tracks which the sewing machine can follow to duplicate a preexisting pattern. Examples are U.S. Pat. No. 334,275 to Palmer which discloses a Machine for Quilting Bed Comfortables, &c. and U.S. Pat. No. 2,236,421 to Boettcher which discloses an Automatic Fabric Stitcher. These devices, like those that use the manual tracing method can duplicate a design, but cannot create one.

A previous quilting machine which does have pattern creation capabilities is disclosed by U.S. Pat. No. 437,439 to Lefeber and entitled Quilting Machine. This machine is of the type having a stationary sewing machine and means for moving the workpiece. The workpiece is held in a frame which rotates relative to the sewing machine about a center of rotation which is offset from the needle along an axis. In addition, a cam moves the frame reciprocally along the same axis. By interchanging cams of different profiles, the amplitude and frequency of the reciprocal movement are changed, varying the pattern stitched.

SUMMARY OF THE INVENTION

The present invention comprises a pattern making jig for a quilting machine of the type having a sewing machine moveably mounted on a table. The jig includes a pair of jig rails secured to the table and a jig body moveable along the jig rails. A stationary gear is fixedly connected to the jig body. A pinion gear carrier rotatably connected to the jig body carries a pinion gear which is engageable with the stationary gear for orbital movement thereabout. The pinion gear carrier is adjustable to accommodate pinion gears of various sizes.

A stylus wheel shares a common shaft with the pinion gear and has a plurality of stylus receivers formed therein. A stylus secured to the sewing machine is receivable in any one of the stylus receivers in the stylus wheel. When the pinion gear carrier is rotated, the pinion gear simultaneously rotates about the shaft and orbits about the stationary gear, causing the stylus wheel to do the same. The motion of the stylus wheel is transferred to the sewing machine causing it to stitch a pattern into the quilt. The pattern is determined by the size of the pinion gear and the stylus receiver selected.

DETAILED DESCRIPTION OF THE PREFERRED EMBODIMENTS

Figure 1:
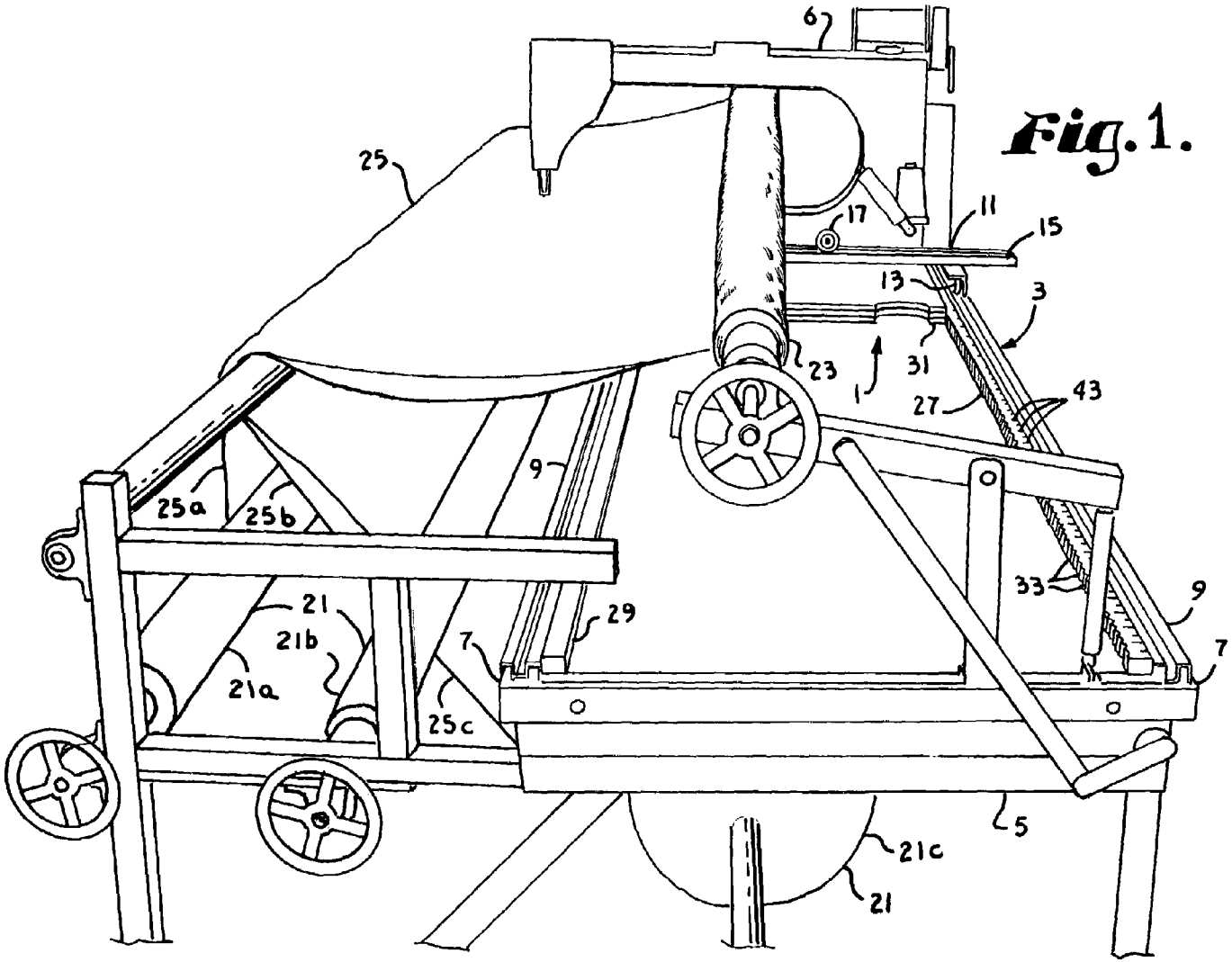
FIG. 1 is a perspective view of a quilting machine with a pattern making jig according to the present invention installed thereon.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates a variable pattern making jig according to the present invention. The jig 1 is for use with a quilting machine 3 which generally comprises an elongate stand or table 5 and a sewing machine 6 moveably mounted on the table 5. Quilting machines of this type are manufactured by Gammill Quilting Systems of West Plains Missouri.

The table 5 includes a pair of opposed longitudinal edges 7 and is equipped with a pair of longitudinal tracks 9, each of which is mounted proximate a respective one of the longitudinal edges 7. The sewing machine 6 is supported on a moveable platform 11 which includes a plurality of wheels or rollers 13 which rollingly engage the longitudinal tracks 9 so as to allow for longitudinal movement of the platform 11 along the table 5.

Mounted on the upper surface of the platform 11 are a set of lateral tracks 15. The sewing machine 6 is rollably supported on the lateral tracks 15 by wheels or rollers 17 such that the sewing machine 6 is free to move in a lateral direction along the lateral tracks 15. The sewing machine 6 is thus both longitudinally and laterally moveable relative to the table 5.

The quilting machine 3 further includes one or more supply rolls 21 mounted adjacent the table 5 and a take up roll 23 mounted above the table 5 and extending through the throat of the sewing machine. Layers of material 25 to be quilted are dispensed from the supply rolls 21 in a web which passes through the sewing machine 6. The sewing machine 6 is operated to stitch the layers of material 25 together and the completed quilt is collected on the take up roll 23. There may be, for example, one supply roll 21*a* for a top material 25*a* of a quilt, a second supply roll 21*b* for a backing material 25*b*, and a third supply roll 21*c* for the filling material 25*c*.

The jig 1 serves to move the sewing machine 6 in a preselected path relative to the material 25 so as to stitch a desired pattern into the material 25. The jig 1 includes a pair of elongate jig rails 27 and 29 which are securable to the table 5 and a generally square moveable jig assembly or jig body 31 which is moveable along and between the jig rails 27 and 29. Each jig rail 27 or 29 is positioned proximate a respective one of the longitudinal tracks 9. The jig rail 27 has teeth 33 formed along its inward edge.

Figure 2:
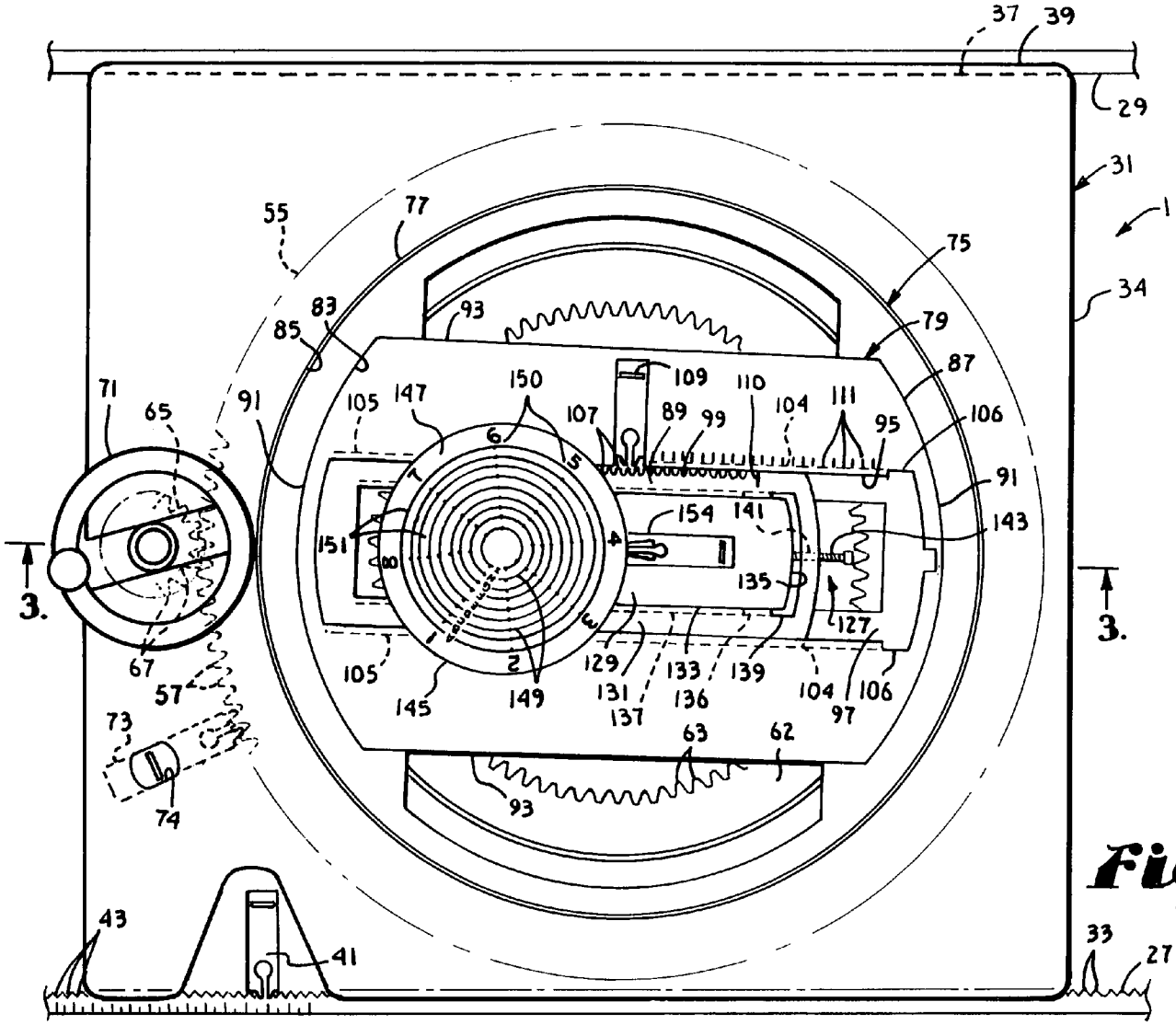
FIG. 2 is a top view of the pattern making jig.
Figure 3:
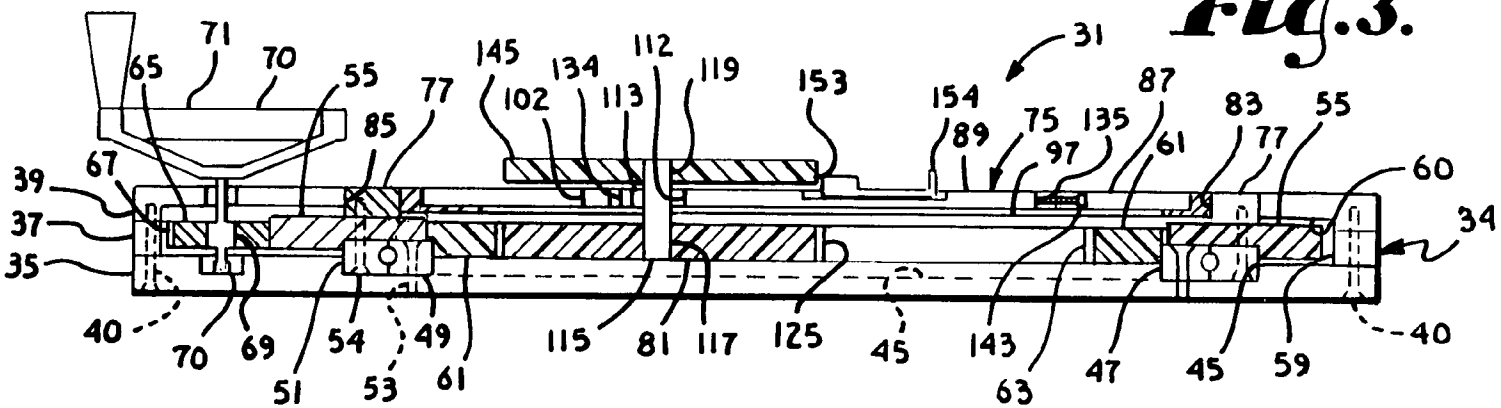
FIG. 3 is a cross-sectional view of the pattern making jig taken generally along line 3—3 in FIG. 2.

Referring to FIGS. 2 and 3, the jig body 31 includes a base 34 which is comprised of three plates; a lower plate 35, a middle plate 37, and an upper plate 39. The plates 35, 37 and 39 are interconnected by fasteners 40, which may be flathead machine screws. The lower plate 35 is sized to fit between the jig rails 27 and 29. The middle plate 37 overlaps and is slidable on the jig rails 27 and 29. A slide lock 41 is slidably mounted on the lower plate 35 for selectively fixing the jig body 31 in position relative to the table 5 by engaging selected ones of the teeth 33 on jig rail 27. Jig rail 27 preferably includes graduations 43 (see FIG. 1) for establishing a desired position of the jig body 27 relative to the table 5.

The lower plate 35 of the base 34 has an annular groove 45 formed in its upper surface which receives a large annular ball bearing assembly 47. The bearing assembly 47 has an inner race 49 and an outer race 51 9see left side of FIG. 3). The inner race 49 is secured to the lower plate 35 by fasteners 53, which may be flathead machine screws. Secured to the outer race 51 of the bearing assembly 47 by fasteners 54 (which, again, may be flathead machine screws) is a moveable annular ring gear 55 having teeth 57 formed around its outer diameter, i.e. the teeth 57 project radially outward as shown in phantom lines in FIG. 2. Referring again to FIG. 3, the moveable ring gear 55 lies above the lower plate 35 at a level generally contiguous with the middle plate 37. The middle plate 37 includes a large central aperture 59 which provides clearance for the moveable ring gear 55. Additional clearance for the moveable ring gear 55 is provided by an annular groove 60 formed in the underside of the upper plate 39.

A stationary ring gear 61 having internal teeth 63 (as shown in FIG. 2) is mounted to the lower plate 35 inside of the bearing assembly 47 and is secured to the lower plate 35 by fasteners 64, which may be flathead machine screws. The number of teeth 63 on the stationary ring gear 61 is a factor in determining the patterns to be produced by the jig 1 and will be represented herein by the variable $n_s$.

Referring to the left side of FIGS. 2 and 3, the moveable ring gear 55 is rotated by a drive gear 65 having teeth 67 which mesh with the teeth 57 of the moveable ring gear 55. The drive gear 65 is fixed to a shaft 69 journaled between bearings 70 mounted in the lower plate 35 and upper plate 39. The shaft 69 extends upwardly from the upper plate 39 and is connected to a hand crank 71. A slide lock 73 is slidably mounted between the upper plate 39 and the middle plate 37 and acts to selectively lock the moveable ring gear 55 by engaging the teeth 57 of the moveable ring gear 55. An opening 74 in the top plate 39 provides access to the slide lock 73.

Figure 4:
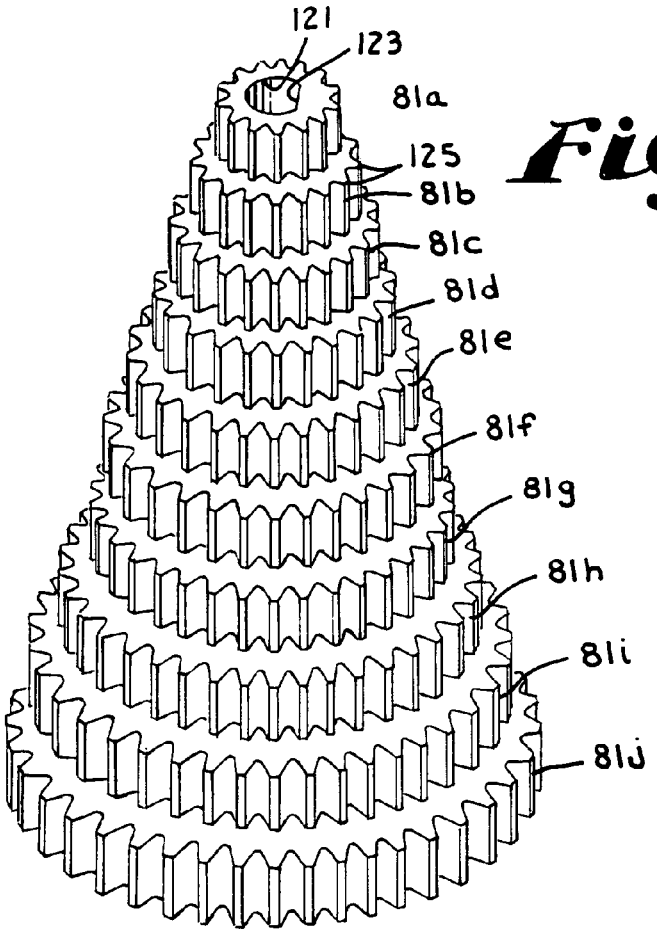
FIG. 4 is a perspective view of a set of interchangeable pinion gears for use with the pattern making jig.
Figure 5:
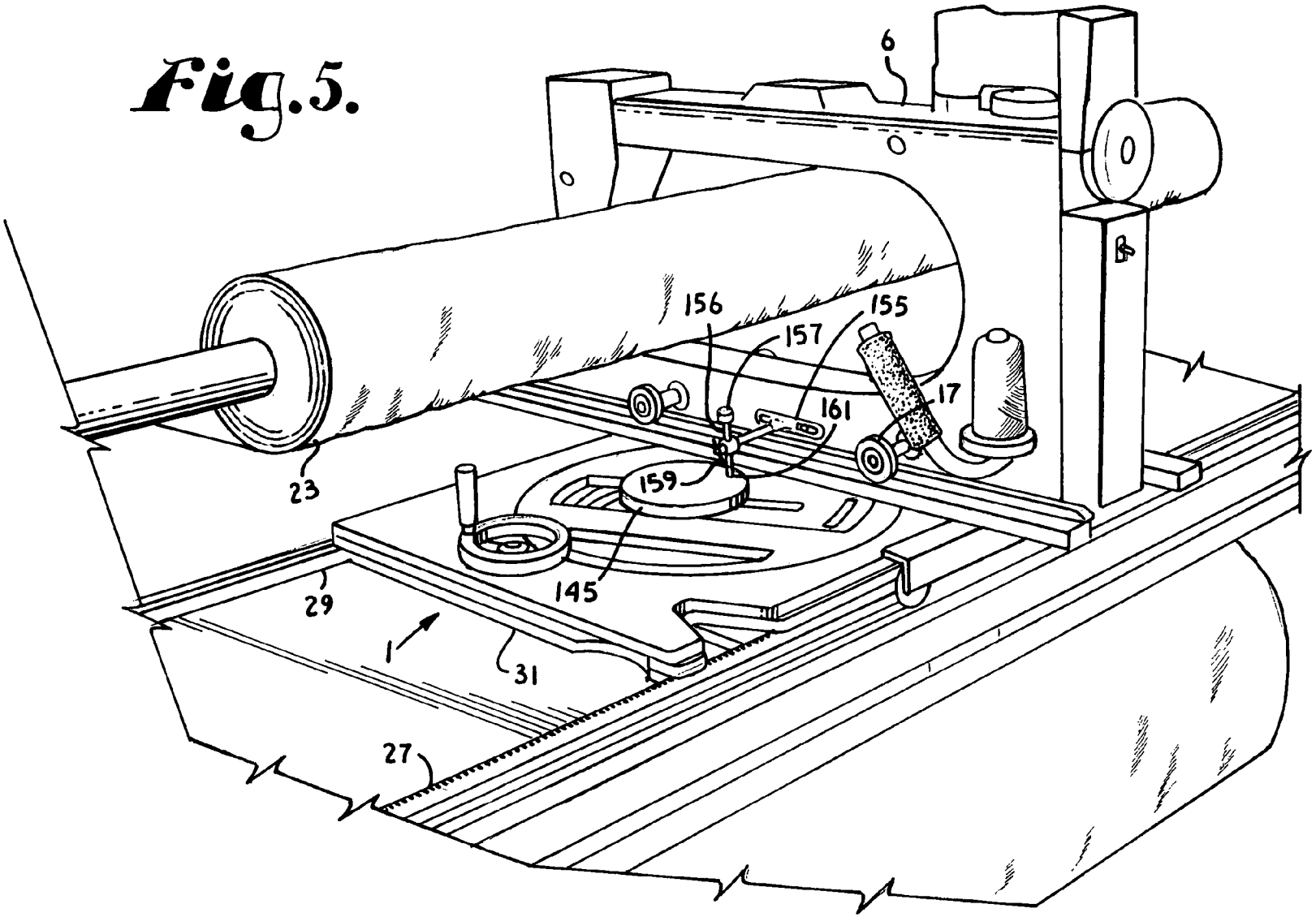
FIG. 5 is an enlarged perspective view of a stylus and stylus bracket for use with the pattern making jig.

Mounted to the upper face of the moveable ring gear 55 is a pinion gear carrier assembly 75 which comprises a carrier holder 77, an adjustable pinion gear carrier 79, and a set of interchangeable pinion gears 81 (see FIG. 4). The carrier holder 77 generally comprises a round plate having a cutout 83 sized and shaped to receive and retain the adjustable pinion gear carrier 79. The carrier holder 77 may be secured to the upper surface of the moveable ring gear 55 by the same fasteners 54 that attach the moveable ring gear 55 to the outer race 51 of bearing assembly 47. The upper plate 39 includes a central aperture 85 which provides clearance for the carrier holder 77.

The adjustable pinion gear carrier 79 generally comprises a base plate 87 which is removably received in the cutout 83 of the carrier holder 77 and a slider 89 which is slidably attached to the base plate 87: The base plate 87 is shown as having rounded ends 91 and opposed parallel sides 93. The base plate 87 further includes a central slot 95 which receives the slider 89. The central slot 95 includes an inwardly extending bottom ledge 97 upon which the slider 89 is supported. When the base plate 87 of pinion gear carrier 79 is installed in the carrier holder 77, slot 95 lies along a diameter of the carrier holder 77.

The slider 89 has opposed longitudinal edges 99 and 101 and first and second ends 102 and 103, respectively. The slider 89 is retained in the slot 95 by ears 104 which extend outwardly from the edges 99 and 101 and are received in grooves 105 formed in the sides of the slot 95. Vertical slots 106 allow the ears 104 to be inserted into the grooves 105.

The slider 89 has teeth 107 formed along its longitudinal edge 99. A slide lock 109 is slidably mounted to the base plate 87 adjacent to the longitudinal edge 99 of slider 89 and selectively engages teeth 107 to lock the slider 89 relative to the base plate 87. The slider 89 further includes a pointer 110 formed on its top surface proximate the longitudinal edge 99. A set of graduations 111 on the base plate 87 proximate the slot 95 cooperate with the pointer 110 to indicate the position of the slider 89 along the slot 95.

A vertical receiver 112 is formed through the slider 89 proximate its first end 102. The receiver 112 accepts a ball bearing assembly 113 which, in turn, rotatably receives a shaft 115. The shaft 115 includes a lower portion 117 which extends downwardly from the slider 89 and an upper portion 119 which extends upwardly from the slider 89. The lower portion 117 of the shaft 115 is adapted to receive a selected one of the interchangeable pinion gears 81 and to prevent the selected pinion gear 81 from rotating relative to the shaft 115. For example, the shaft 115 may be semi-cylindrical with one flat edge, while each pinion gear 81 has a center hole 121 with a matching flat edge 123 (see FIG. 4).

Referring to FIG. 4, the pinion gears 81 are of varying diameters and have teeth 125 adapted to mesh with the teeth 63 of the stationary ring gear 61. For example, the pinion gears 81 may include ten interchangeable gears 81*a*–81*j* wherein each successive gear 81 has an incrementally greater diameter. The number of teeth 125 on each pinion gear 81 is a factor in determining the pattern to be produced when that pinion gear is installed on the jig 1, and will be represented herein by the variable n*p*.

The adjustable pinion gear carrier 79 allows the various sized pinion gears 81 to be moved into meshing contact with the stationary ring gear 61. In order to install a pinion gear 81, the pinion gear carrier 79 is removed from the carrier holder 77, exposing the lower portion 117 of the shaft 115. A pinion gear 81 is placed on the lower portion 117 of the shaft 115 and the pinion gear carrier 79 is reinstalled in the carrier holder 77 by inserting the base plate 87 of the pinion gear carrier 79 into the cutout 83 of the carrier holder 77. The pinion gear 81 is then advanced into contact with the stationary ring gear 61 by moving the slider 89. The slide lock 109 is then engaged with the teeth 107 on the longitudinal edge 99 of the slider 89 to lock the slider 89 relative to the base plate 87 and hold the pinion gear 81 in meshing contact with the stationary ring gear 61.

The adjustable pinion gear carrier 79 further includes a fine adjustment mechanism 127 for adjusting the clearance between the teeth 125 of the installed pinion gear 81 and the teeth 63 of the stationary ring gear 61. The slider 89 is split into an inner section 129 and an outer section 131. The inner section 129 has opposed longitudinal edges 133 and opposed first and second ends 134 and 135, respectively. The inner section 129 is slidable relative to the outer section 131 and is retained in the outer section 131 by ears 136 which extend outwardly from the edges 133 of the inner section 129 and are received in grooves 137 formed in the outer section 131. Vertical slots 139 allow the ears 136 to be inserted into the grooves 137.

A threaded receiver 141 is formed in the second end 103 of the slider 89 and extends through the outer section 131. The receiver 141 receives an adjustment screw 143 which extends through the receiver 141 and buts against the second end 135 of the inner section of the slider 89. By turning the screw 143, an operator can adjust the clearance between the pinion gear 81 and the stationary ring gear 61, or the pressure exerted by the pinion gear 81 acting against the stationary ring gear 61.

The upper portion 119 of the shaft 115 receives a stylus wheel 145. The stylus wheel 145 has an upper surface 147 with a plurality of stylus receivers 149 formed therein. The receivers 149 are arranged in a plurality of radially extending rows 150 and are evenly spaced along the rows 150 to form a plurality of concentric rings 151. The receivers 149 are thus both circumferentially and radially spaced across the upper surface 147 of the stylus wheel 145. Each receiver 149 is eccentric from the center of the wheel 145.

Indicia is preferably provided on the stylus wheel 145 to quickly locate and identify each particular receiver 149. If, for example, the stylus wheel 145 has eight radially extending rows 150, the rows 150 may be labeled 1–8 around the circumference of the stylus wheel 145. If there are eight evenly spaced receivers 149 in each row 150, they will be laid out in nine concentric rings 151 which may be labeled A–I with the ring labeled A being the outermost ring 151 and the ring labeled I being the innermost ring 151. (Note that the device is pictured with a ninth ring 151 having only a single stylus receiver 149 in the radial row 150 labeled 1.) Each receiver 149 can thus be identified by a row 150 designation and a ring 151 designation, for example "6E" or "14B."

The outer circumference of the stylus wheel 145 has circumferentially spaced notches 153 formed therein. A slide lock 154 is slidably attached to the slider 89 and is selectively engageable with the notches 153 to prevent rotation of the stylus wheel 145 relative to the slider 89.

A stylus bracket 155 connected to the sewing machine 6 has a vertical receiver 156 which receives a stylus 157. A thumbscrew 159 tightens against the stylus 157 to retain it in a selected position or loosens to allow the stylus 157 to be raised and lowered. The stylus 157 has a distal end or tip 161 which is receivable in any one of the stylus receivers 149 in the stylus wheel 145.

The majority of the components of the jig 1, including the jig rails 27 and 29, plates, 35, 37 and 39, gears 55, 61, 65, and 81, slide locks 41, 73, 109 and 153, carrier holder 77, carrier base plate 87, slider 89, and stylus wheel 145 are preferably machined out of sheets of a high density polyethylene material. The sheets preferably have multiple layers of different colors (such as a white layer sandwiched between black layers) such that the various indica may be imprinted on the parts by machining through an outer layer to expose the inner layer. The indica which can be formed in this way include the graduations 43 on the jig rail 27, the pointer 110 on the slider 89, the graduations 111 on the carrier base plate and the indicia 152 on the stylus wheel 145. Additional indicia (not shown) such as brand names, logos, and decorative designs may also be formed in this manner.

In use, the jig rails 27 and 29 are first secured to the table 5 proximate the respective longitudinal edges 7. The jig body 31 is then placed in sliding engagement with the jig rails 27 and 29. The position of the jig body 31 along the jig rails 27 and 29 is selected to place the needle and foot of the sewing machine 6 in an area on the material 25 where it is desired to sew a pattern.

The pattern is made by turning the hand crank 71. As the hand crank 71 is turned, the drive gear 65 engages the moveable ring gear 55, causing the moveable ring gear 55 to rotate on the large bearing assembly 47. The rotation of the moveable ring gear 55 is transferred to the attached pinion-gear carrier assembly 75, causing orbital movement of the stylus wheel 145, shaft 115 and the pinion gear 81. As the pinion gear 81 orbits, its teeth 125 engage the teeth 63 on the stationary ring gear 61, causing the pinion gear 81, shaft 115 and stylus wheel 145 to rotate.

As the stylus wheel 145 orbits and rotates, motion is transferred to the sewing machine 6 through the stylus 157 and stylus bracket 155. As the sewing machine 6 moves, a pattern is stitched into the material 25. The specific pattern is determined by the selection of the pinion gear 81 and the stylus receiver 149.

The basic shape of the pattern is determined by the pinion gear 81 chosen. The ratio of the number $n_s$ of teeth 63 on the stationary ring gear 61 to the number $n_p$ of teeth 125 on the pinion gear 81 determines the number of lobes or "petals" which are created as the pinion gear 81 makes one orbit around the ring gear 61. If the number $n_p$ of teeth 125 on the pinion gear 81 is an even divisor of the number $n_s$ of teeth 63 on the ring gear 61, then a complete pattern will be made by one orbit of the pinion gear 81 around the stationary ring gear 61 and the number of lobes on the pattern will be determined by dividing the number $n_s$ of teeth 63 on the stationary ring gear 61 by the number $n_p$ of teeth 125 on the pinion gear 81:

$$\frac{n_s}{n_p}$$

For example, if there are one hundred and twenty teeth 63 on the stationary ring gear 61 ($n_s$=120), and a pinion gear 81 is selected with forty teeth 125 ($n_p$=40), a pattern with three lobes will be produced by the jig 1. Similarly, a pinion gear 81 with sixty teeth 125 will produce a pattern with two lobes, a pinion gear 81 with twenty teeth 125 will produce a pattern with six lobes, etc.

If the number $n_p$ of teeth 125 on the pinion gear 81 is not an even divisor of the number $n_s$ of teeth 63 on the stationary ring gear 61, then a complete pattern will not be formed by a single orbit of the pinion gear 81 around the stationary ring gear 61. The number $n_s$ of teeth 63 on the stationary ring gear divided by the number $n_p$ of teeth 125 on th pinion gear 81 becomes a fraction, which when reduced to its lowest terms, is the number of lobes in the complete pattern over the number of orbits of the pinion gear 81 about the stationary ring gear 61 required to complete the pattern. For example, if the stationary ring gear 61 has one hundred and twenty teeth 63 and the pinion gear 81 has fifty teeth 125, then the formula works as follows:

$$\frac{n_s}{n_p} = \frac{120}{50} = \frac{12}{5}$$

Therefore, the pattern will have twelve lobes and will be produced in five orbits of the pinion gear 81 around the stationary ring gear 61.

The selection of the stylus receiver 149 used determines the size and the angular orientation of the pattern and effects the shape of the lobes. The size of the pattern is determined by the ring 151 in which the selected receiver 149 lies. A receiver 149 along the outermost ring (the ring 151 labeled A) produces the largest pattern. A receiver 149 along the innermost ring 151 (the ring 151 labeled 1) produces the smallest pattern. The angular orientation of the pattern is determined by the radial row 150 of the selected receiver 149.

Circular patterns are made by moving the pinion gear 81 out of engagement with the stationary ring gear 61 by moving the slider 89 (or by removing the pinion gear 81) and locking the stylus wheel 145 using the slide lock 154. In this configuration, the stylus wheel 145 continues to be moveable in an orbital motion but will not rotate, resulting in a circular pattern.

Figure 6:
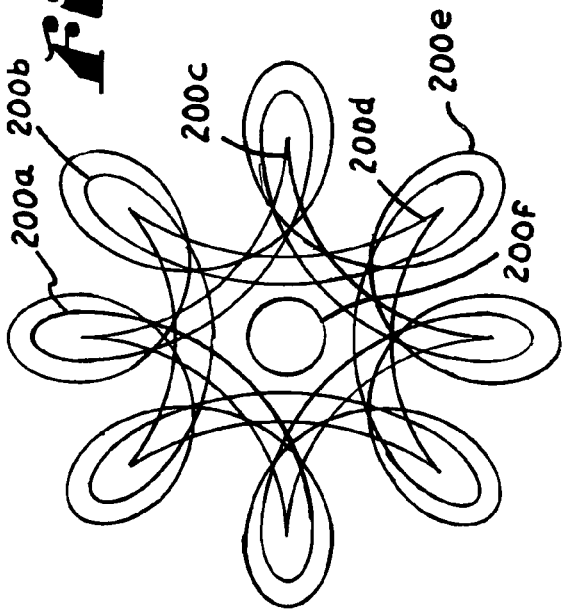
FIG. 6 is a schematic view of a complex pattern which can be stitched by the quilting machine using the pattern making jig of the present invention.

More complex patterns are formed by combining patterns. For example, the complex pattern 200 shown in FIG. 6 is a combination of six separate patterns indicated by reference numerals 200*a*–200*f*. Pattern 200*a* is a four lobe pattern made using a pinion gear 81 having a number $n_p$ of teeth 125 which is one fourth the number $n_5$ of teeth 63 on the stationary ring gear 61. Pattern 200*a* is made with the stylus 157 inserted in a first stylus receiver 149 which, by way of example, may be the stylus receiver 149 with designation 1A. Pattern 200*b* is identical to pattern 200*a*, but its position is rotated forty-five degrees. It is made with the same pinion gear 81 and with the stylus 157 in a stylus receiver 149 which is in the same ring 151 but in a radial row 150 which produces a pattern which is forty-five degrees off from pattern 200*a*, which may be, for example, the stylus receiver 149 with designation 3A.

Pattern 200*c* is also a four lobe pattern made with the same pinion gear as was used for patterns 200*a* and 200*b*. It is in the same angular orientation as pattern 200*a*, but it is smaller and the shape of its lobes is altered. It is made with the stylus 157 in a stylus receiver 149 which is in the same radial row 150 as was used for pattern 200*a*, but in a ring 151 which is inwardly spaced from that used for pattern 200*a*, for example the stylus receiver 149 with designation 1C. Pattern 200*d* is identical to pattern 200*c*, but its position is rotated forty-five degrees. It is made with the same pinion gear 81 and with the stylus 157 in a stylus receiver 149 which is in the same ring 151 but in a radial row 150 which produces a pattern which is forty five degrees off from pattern 200*c*, which may be, for example, the stylus receiver 149 with designation 3C.

Pattern 200*e* is an eight lobe pattern made using a pinion gear 81 having a number $n_p$ of teeth 125 which is one eighth the number $n_s$ of teeth 63 on the stationary ring gear 61. It is in the same angular orientation as pattern 200*a* and is made with the stylus 157 inserted in the same stylus receiver 149, which was the stylus receiver 149 with designation 1A.

Pattern 200*f* is a circular pattern made by moving the slider 89 until the stylus wheel 145 is centered on the pinion gear carrier 79 and locking the stylus wheel 145 in place using the slide lock 154. Because it is a small circle, it is made with the stylus 157 in a stylus receiver 149 which is one of the more inwardly spaced rings, for example the stylus receiver 149 with designation 1G.

Once the desired pattern is completed, the jig body 31 can be moved along the jig rails 27 and 29 so that a new portion of the material 25 is in position proximate the sewing machine 6 to be sewn. When a row of patterns is completed, the completed portion is rolled toward the take up roll 23 and the process is repeated until a quilt is completed.

It is to be understood that while certain forms of the present invention have been illustrated and described herein, it is not to be limited to the specific forms or arrangement of parts described and shown.

What is claimed and desired to be secured by Letters Patent is as follows:

1. A pattern making jig for a quilting machine of the type having a sewing machine moveably mounted on a table, comprising:

a) a jig body mountable on the table;

b) a stationary gear fixedly connected to said jig body;

c) a pinion gear carrier rotatably connected to said jig body, said pinion gear carrier carrying a pinion gear engageable with said stationary gear for orbital movement thereabout; and d) a stylus wheel operably connected to said pinion gear, said stylus wheel having at least one stylus receiver formed therein;

e) a stylus securable to said sewing machine and receivable in said stylus receiver in said stylus wheel.

2. The pattern making jig as in claim 1 and further including a pair of jig rails securable to the table wherein said jig body is selectively moveable along said jig rails.

3. The pattern making jig as in claim 2 wherein one of said jig rails has teeth formed therein and said jig body includes a slide lock engageable with selected ones of said teeth to lock said jig body in position relative to the table.

4. The pattern making jig as in claim 1 wherein said pinion gear is one of a set of interchangeable pinion gears of varying diameters.

5. The pattern making jig as in claim 4 wherein said pinion gear carrier is adjustable to accommodate any one of said set of interchangeable pinion gears.

6. The pattern making jig as in claim 1 wherein said stylus wheel has a plurality of stylus receivers formed therein, at least one of said stylus receivers being eccentric from the center of rotation of said stylus wheel.

7. The pattern making jig as in claim 5 wherein said stylus receivers are radially spaced.

8. The pattern making jig as in claim 5 wherein said stylus receivers are circumferentially spaced.

9. The pattern making jig as in claim 1 wherein said pinion gear and said stylus wheel are fixedly mounted on a common shaft.

10. The pattern making jig as in claim 1 wherein said stationary gear is a ring gear having internal teeth.

11. A variable pattern making jig for a quilting machine of the type having a sewing machine moveably mounted on a table, comprising:

a) a jig body selectively moveable along the table;
b) a stationary ring gear fixedly connected to said jig body, said stationary ring gear having internal teeth;
c) a moveable ring gear rotatably connected to said jig body concentric with said stationary ring gear, said moveable ring gear having external teeth;
d) a drive gear rotatably connected to said jig body and in meshing engagement with said moveable ring gear;
e) a hand crank connected to said drive gear;
f) a pinion gear carrier assembly comprising:
  i) a base plate removably connected to said moveable ring gear, said base plate having a slot formed therethrough;
  ii) a slider moveably connected to said base plate along said slot, said slider having a vertical receiver formed therethrough;
  iii) a shaft rotatably connected to said slider and extending through said vertical receiver and said slot in said base plate;
g) a set of interchangeable pinion gears of varied diameters, any selected one of said set being receivable on a lower end of said shaft and engageable with said stationary ring gear;
h) a stylus wheel mounted on an upper end of said shaft, said stylus wheel having an upper surface with at least one stylus receiver formed therein; and
i) a stylus connectable to the sewing machine so as to extend downwardly therefrom, said stylus having a tip receivable within said stylus receiver.

12. The pattern making jig as in claim 11 and further including a pair of jig rails securable to the table wherein said jig body is selectively moveable along said jig rails.

13. The pattern making jig as in claim 12 wherein one of said jig rails has teeth formed therein and said jig body includes a slide lock engageable with selected ones of said teeth to lock said jig body in position relative to the table.

14. The pattern making jig as in claim 11 wherein said stylus wheel has a plurality of stylus receivers formed therein, at least one of said stylus receivers being eccentric from the center of rotation of said stylus wheel.

15. The pattern making jig as in claim 14 wherein said stylus receivers are radially spaced.

16. The pattern making jig as in claim 14 wherein said stylus receivers are circumferentially spaced.

17. A variable pattern making jig for a quilting machine of the type having a sewing machine moveably mounted on a table, comprising:

a) a pair of jig rails securable to the table;
b) a jig body selectively moveable along said jig rails;
c) a stationary ring gear fixedly connected to said jig body, said stationary ring gear having internal teeth;
d) a bearing assembly concentric with said stationary ring gear and spaced outwardly therefrom, said bearing assembly having inner and outer races; one of said inner and outer races being connected to said jig body;
e) a moveable ring gear connected to the other of said inner and outer races, said moveable ring gear having external teeth;
f) a drive gear rotatably connected to said jig body and in meshing engagement with said moveable ring gear;
g) a hand crank connected to said drive gear;
h) a pinion gear carrier assembly comprising:
  i) a base plate removably connected to said other of said inner and outer races, said base plate having a slot formed therethrough;
  ii) a slider moveably connected to said base plate along said slot, said slider having a vertical receiver formed therethrough;
  iii) a shaft rotatably connected to said slider and extending through said vertical receiver and said slot in said base plate;
i) a set of interchangeable pinion gears of varied diameters, any selected one of said set being receivable on a lower end of said shaft and engageable with said internal teeth of said stationary ring gear;
j) a stylus wheel mounted on an upper end of said shaft, said stylus wheel having an upper surface with at least one stylus receiver formed therein; and
k) a stylus connectable to the sewing machine so as to extend downwardly therefrom, said stylus having a tip receivable within said stylus receiver.

18. The pattern making jig as in claim 17 wherein said stylus wheel has a plurality of stylus receivers formed therein, at least one of said stylus receivers being eccentric from the center of rotation of said stylus wheel.

19. The pattern making jig as in claim 18 wherein said stylus receivers are radially spaced.

20. The pattern making jig as in claim 18 wherein said stylus receivers are circumferentially spaced.

* * * * *